United States Patent [19]

Ives et al.

[11] 4,056,140

[45] Nov. 1, 1977

[54] METHOD AND MECHANISM FOR CONTROLLING FORCES IN A CONTINUOUS-CASTING MACHINE

[75] Inventors: Kenneth D. Ives, Franklin Township, Westmoreland County; Ronald S. Vranka, Monroeville; George J. Wagner, Jr., North Fayette Township, Allegheny County, all of Pa.

[73] Assignee: United States Steel Corporation, Pittsburgh, Pa.

[21] Appl. No.: 734,066

[22] Filed: Oct. 20, 1976

[51] Int. Cl.[2] ..... B21B 37/08; B22D 11/12

[52] U.S. Cl. ..... 164/4; 164/154; 164/448; 72/21; 72/246

[58] Field of Search ..... 164/282, 4, 82, 154; 72/19, 21, 246, 248, 35, 8

[56] References Cited

U.S. PATENT DOCUMENTS

| | | | |
|---|---|---|---|
| 2,680,976 | 6/1954 | Hessenberg et al. | 72/21 |
| 2,796,781 | 6/1957 | Mills | 72/246 |
| 3,345,848 | 10/1967 | Henschker | 72/246 X |
| 3,496,743 | 2/1970 | Stone | 72/8 |

*Primary Examiner*—Milton S. Mehr
*Attorney, Agent, or Firm*—Walter P. Wood

[57] ABSTRACT

A method and mechanism for controlling forces exerted between opposed roll-pairs of a continuous-casting machine and a casting traveling therebetween. Each roll pair is equipped with a load cell for measuring the force. If the force at any roll-pair deviates from the norm, it is an indication that the dimension of the gap between rolls of that pair requires correction. Correction is effected through a screw threaded adjusting means.

16 Claims, 5 Drawing Figures

METHOD AND MECHANISM FOR CONTROLLING FORCES IN A CONTINUOUS-CASTING MACHINE

This invention relates to improved methods and mechanisms for controlling forces exerted between opposed roll-pairs of a continuous-casting machine and a casting traveling therebetween.

In a conventional continuous-casting operation, a partially solidified casting, which initially has only a thin solidified skin or shell and a liquid core, emerges continuously from the bottom of a water-cooled open-ended mold and travels between a series of opposed roll-pairs while the solidification process continues. The roll-pairs guide the casting and confine it against bulging until it solidifies sufficiently that it is self-sustaining. If the casting is a slab which is wide relative to its thickness, it does not become self-sustaining until itsolidifies throughout its cross section. If the casting is a bloom, which is thick relative to its width, it may become self-sustaining when its end walls solidify to a sufficient depth that they support its side walls even though some of its core remains liquid. To prevent formation of defects in the completed casting, the rolls of each pair must be "gapped" properly; that is, the spacing between the work-engaging faces of the rolls of each pair must be set accurately to a relatively close tolerance. If the gap is too large in the region where the casting is not self-sustaining, the shell bulges, and core cracks or triple-point cracks may form. If the gap is too small in any region, the casting can pass between the rolls only at the expense of causing additional and possibly excessive pressures on the rolls, and possibly harmful tensile stresses in the casting.

An earlier application of Ives and Vranka, Ser. No. 488,177, filed July 12, 1974, now U.S. Pat. No. 3,934,121, describes and claims a continuouscasting machine in which the roll-pairs of the curved roll-rack are equipped with load cells to furnish a continuous measurement of the force exerted between the rolls and the casting. If the rolls are gapped properly, the force increases approximately uniformly from the roll-pair nearest the mold to the roll-pair at which the casting becomes self-sustaining. The force reaches a maximum at the latter roll-pair, whereby the location at which the casting first becomes self-sustaining is readily determined. If the force measurement at any roll-pair is above or below the expected norm, it is an indication that the gap is too small or too large. The correction needed is directly proportional to the amount by which the force deviates from the norm.

The present invention is an improvement over the invention described and claimed in the earlier application. The rolls shown in the earlier application rotate on fixed axes while a casting passes between them. The positions of the rolls can be adjusted to correct the gaps only by inserting or removing shims. This is a time-consuming operation, and can be accomplished only when the casting machine is idle for at least an hour. The only way a large overload can pass between the rolls is for the load cells to be crushed.

An object of the present invention is to provide improved methods and mechanisms for controlling forces exerted between the roll-pairs and a casting in which we simplify the procedure for making corrections in the dimension of the gaps.

A further object is to provide an improved arrangement for mounting load cells on the roll-pairs wherein the load cells are embodied in a stud, which may be either in tension or compression, and all parts are protected from damage caused by overloads.

A further object is to provide improved mechanisms for correcting the dimension of gaps between rolls of an opposed pair in which we utilize adjusting means operatively connected with the roll mounting means for making corrections, preferably screw-threaded studs, thus avoiding need for inserting or removing shims.

Figure 1:
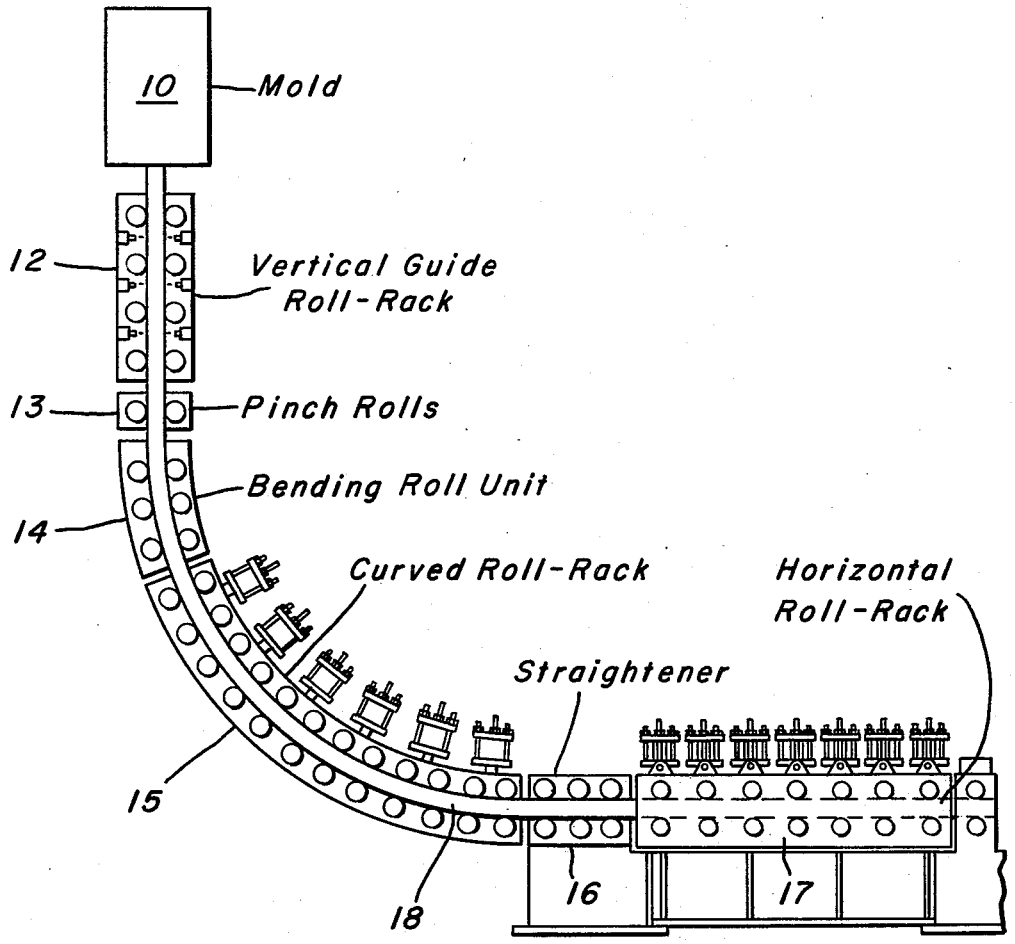
FIG. 1 is a diagrammatic side elevational view of a continuous-casting machine in which the present invention is embodied in both a curved roll-rack and a horizontal roll-rack.

FIG. 1 shows diagrammatically a continuous-casting machine which may be conventional apart from our force-controlling mechanisms. The machine illustrated includes in succession from the top down a mold 10, a vertical guide roll-rack 12, pinch rolls 13, a bending roll unit 14, a curved roll rack 15, a straightener 16, a horizontal roll-rack 17. Liquid metal is poured into mold 10 and a partially solidified casting 18 emerges continuously from the bottom and travels successively through the other aforementioned components. In the machine illustrated, the casting does not become self-sustaining until it is within the horizontal roll-rack 17. Hence it is necessary to confine the casting closely all the way from the mold through at least a portion of the horizontal roll-rack. The machine illustrated is only one example of a machine to which our invention may be applied, and numerous variations are possible. For example, a curved mold could be used and the guide roll rack and bending roll unit eliminated, or the machine could be designed for the casting to become self-sustaining before it reaches the straightener and the horizontal roll-rack eliminated.

We equip the rolls of both the curved roll-rack 15 and horizontal roll-rack 17 with force-controlling mechanisms constructed in accordance with our invention. The mechanisms illustrated on the two racks are different species of our invention, and each is the preferred mode of practicing our invention as applied to the respective racks. Nevertheless it is apparent that the species of mechanism illustrated in either roll-rack can be used in the other. In both roll-racks the parts at opposite sides of the rack are similar, hence we show only the parts at one side.

CURVED ROLL RACK

Figure 3:
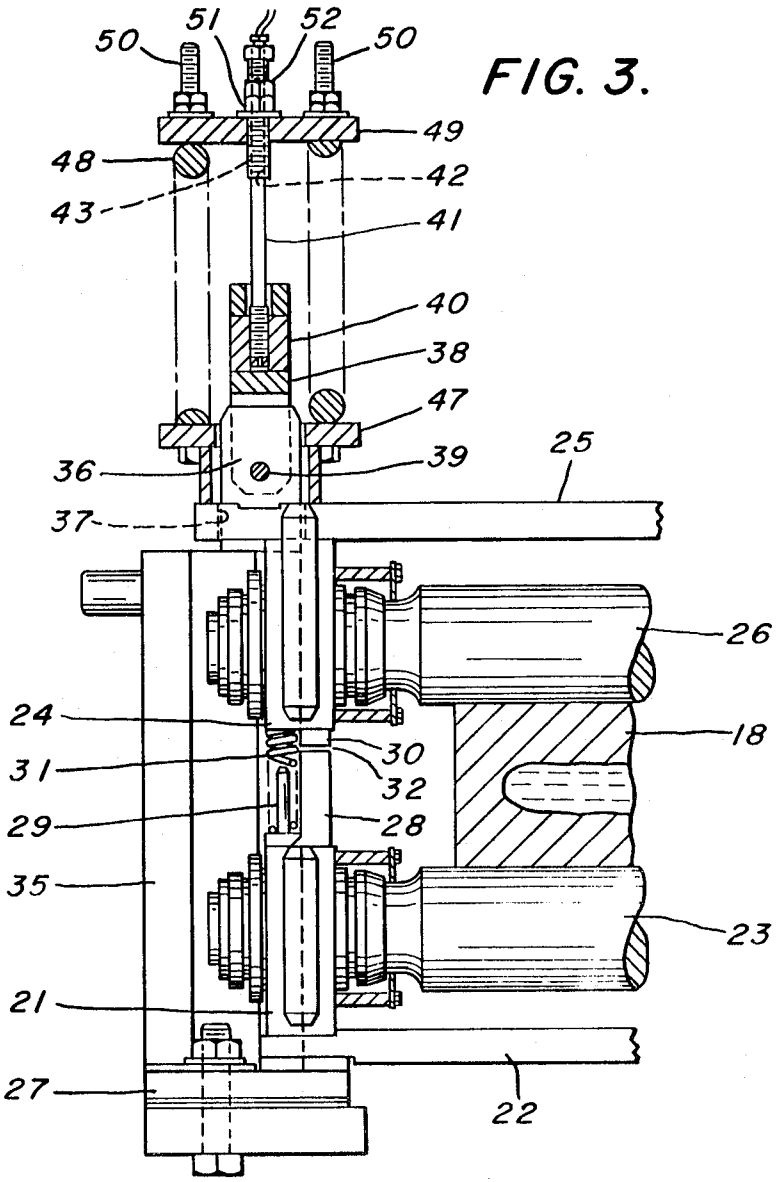
FIG. 3 is a partial elevational view, partly in section, of the structure shown in FIG. 2 taken from the right.
Figure 2:
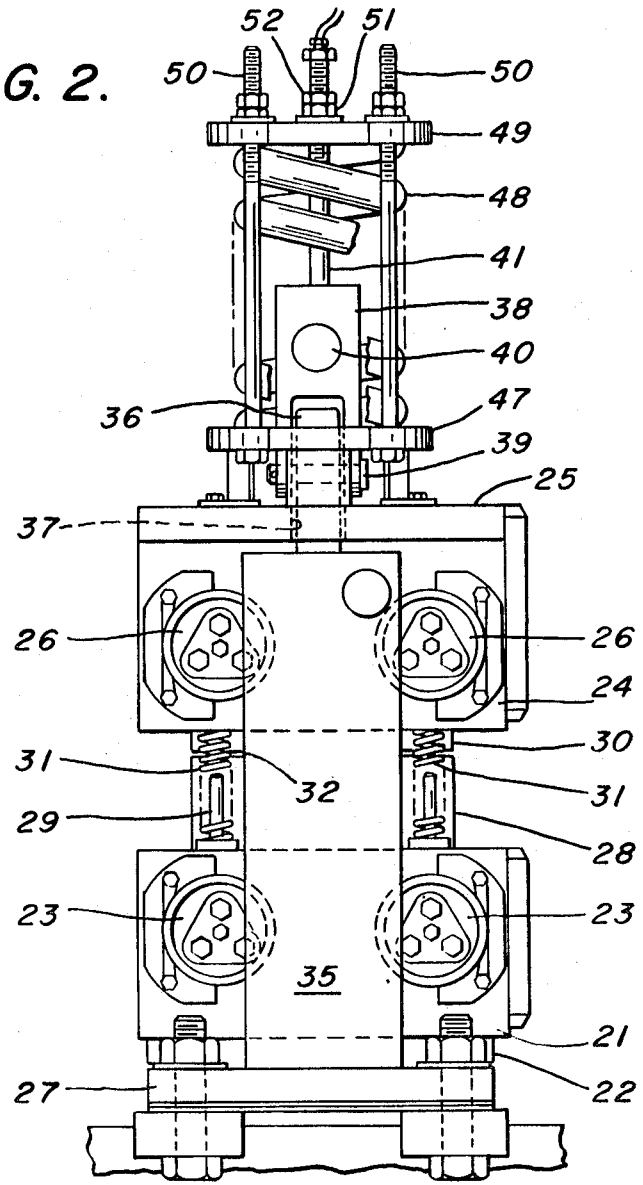
FIG. 2 is a side elevational view on a larger scale of a portion of the curved roll-rack shown in FIG. 1.

FIGS. 2 and 3 show opposed lower and upper clusters of two rolls each and surrounding structure of the curved roll-rack 15. The lower cluster includes a chock 21, a lower spacer bar 22 connected to this chock and to the chock at the other side of the rack, and two lower rolls 23 journaled at opposite ends in the two chocks. Likewise the upper cluster includes a chock 24, an upper spacer bar 25 connected to this chock and to the chock at the other side of the rack, and two upper rolls 26 journaled at opposite ends in the two chocks. The lower spacer bar 22 rests on a base 27. The lower chock 21 carries an upstanding post 28 and a pin 29 alongside the post. The upper chock 24 carries a depending leg 30 aligned with post 28. The upper chock is supported on the lower chock on a yieldable compression spring 31 retained on pin 29. The spring holds the chocks and rolls apart. The post 28 and leg 30 normally are separated by a small gap 32, but may abut to limit the distance by which the upper chock and roll can be lowered.

A tension strap 35 of the T-shape in cross section extends upwardly from the base 27 and at its upper end has an extension 36 which projects through a hole 37 in the upper spacer bar 25. A clevis 38 straddles the extension 36 and is connected thereto with a pin 39. Another pin 40 is received in a hole in the upper portion of the clevis. An upstanding stud 41 is threadedly engaged with a tapped bore in the upper face of pin 40. In the embodiment illustrated, the stud itself is a load cell and it has a lengthwise bore 42 in which a strain gauge 43 is mounted. Other forms of load cell would be equivalent, for example, a ring-type cell surrounding the stud or a shear cell in place of pin 39, etc.

The upper spacer bar 25 carries an annular lower spring retainer 47 which encircles the extension 36 of the tension strap 35 and the clevis 38. A heavy overload compression spring 48 is supported on the retainer 47, encircles the clevis 38, and bears against an annular upper spring retainer 49. A plurality of tie bolts 50 extend between the two spring retainers 47 and 49 to hold the parts in position. The stud 41 extends through the upper spring retainer 49 and has a screw-threaded portion which carries a nut 51 and a lock nut 52. The nut 51 bears against the upper face of the retainer 49.

When a casting 18 is between the rolls 23 and 26, it exerts a downward force on the lower rolls 23 and an upward force on the upper rolls 26. The force on the upper rolls stresses the strap 35, clevis 38, and stud 41 in tension, and the overload spring 48 in compression. The overload spring is sufficiently heavy that it acts as a rigid body during normal operation of the curved roll-rack, but it allows the upper rolls 26 to yield when contacted by an unduly thick portion of a casting such as may appear near its ends. The strain gauge 43 is connected to a suitable read out device (not shown) which indicates the tensile force on the stud or the force exerted between the casting and the rolls. If this force deviates from the norm, indicating that a correction is needed in the dimension of the gap between rolls 23 and 26, we need only turn the nut 51 up or down to make the necessary correction. Turning the nut through a given arc moves the upper rolls a known distance. For example, we find it convenient to proportion the parts so that a quarter-turn of the nut moves the upper rolls 26 0.005 inch. The purpose of the flexible connection which the pin 40 affords between the clevis 38 and stud 41 is to allow limited flexing when the leading end of a casting first abuts the rolls.

HORIZONTAL ROLL-RACK

Figure 5:
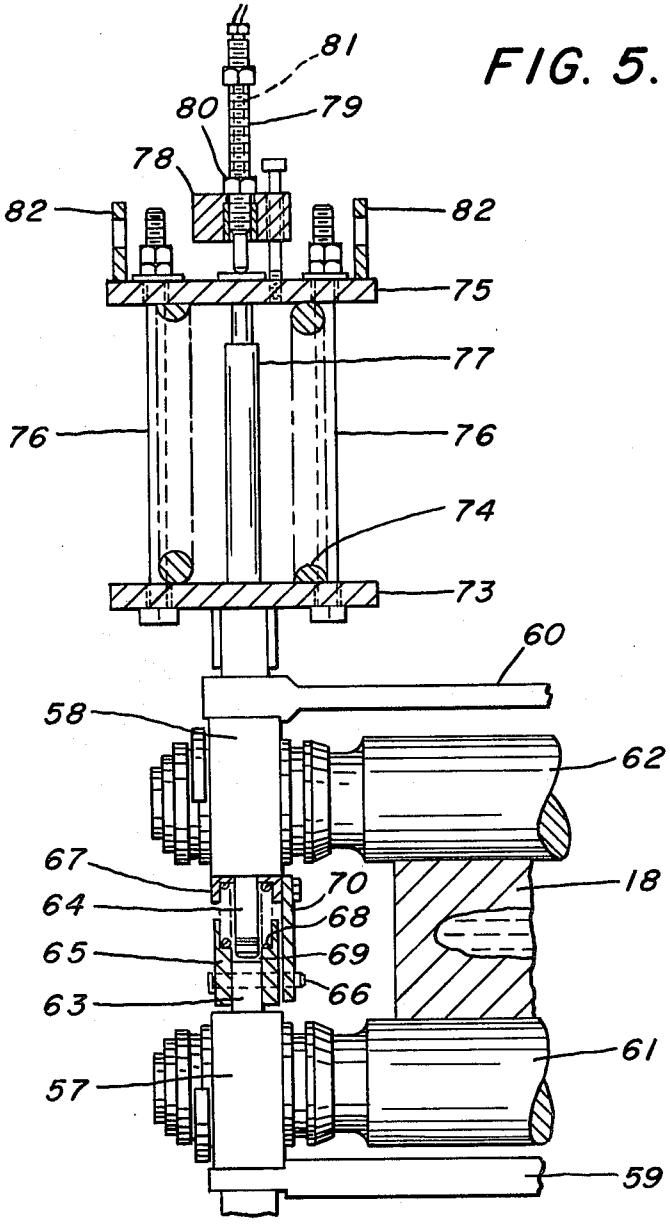
FIG. 5 is a partial elevational view of the structure shown in FIG. 4 taken from the right.
Figure 4:
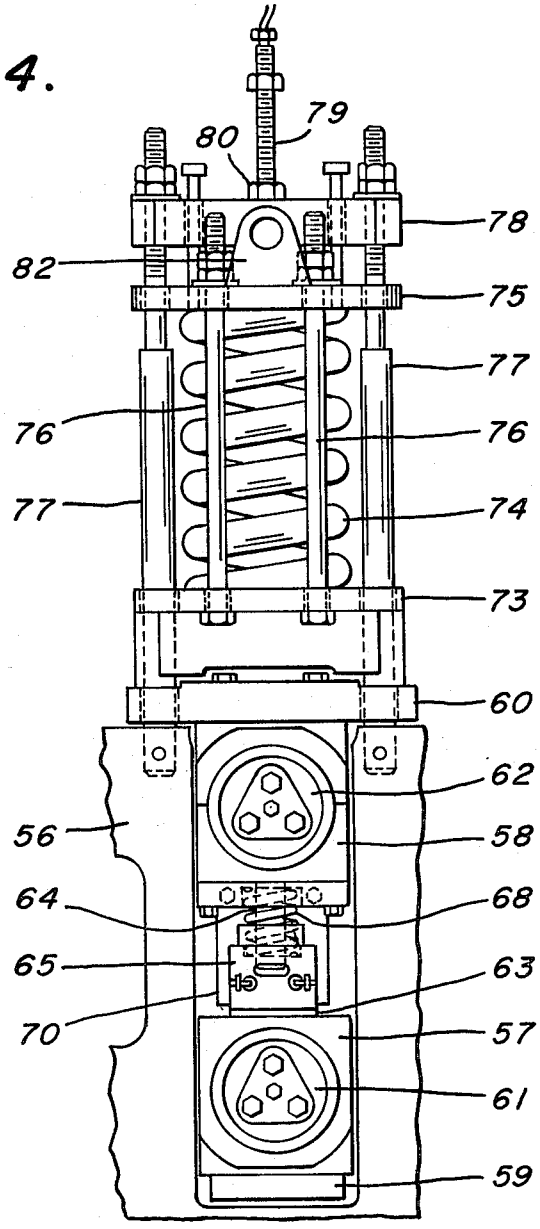
FIG. 4 is a side elevational view on a scale similar to FIG. 2 of a portion of the horizontal roll-rack shown in FIG. 1.

FIGS. 4 and 5 show an opposed roll-pair and surrounding structure of the horizontal roll-rack 17. The rack includes a housing 56 within which are mounted lower and upper chocks 57 and 58. A lower spacer bar 59 is connected to the lower chock 57 and to the chock at the other side of the rack. Similarly an upper spacer bar 60 is connectd to the upper chock 68 and to the chock at the other side. Lower and upper rolls 61 and 62 are journaled at opposite ends in the lower and upper chocks respectively. The lower chock carries an upstanding post 63 and the upper chock a depending leg 64 aligned with the post. A lower spring retainer 65 encircles post 63 and is attached thereto with pins 66. The upper chock carries an upper spring retainer 67. A compression spring 68 encircles the leg 64 and bears against the retainer 65 and 67 to hold the chocks and rolls apart. The post 63 and leg 64 normally are separated by a small gap 69, as in the embodiment already described. The upper chock also carries a depending plate 70 through which pins 66 extend to connect the lower chock with the upper chock, whereby the lower chocks and roll can be lifted from the housing with the upper chocks and roll.

The upper spacer bar 60 carries a lower spring retainer 73 which supports a heavy overload compression spring 74. The upper end of the spring bears against an upper spring retainer 75. A plurality of tie bolts 76 extend between the two spring retainers to hold the parts in position. A pair of upstanding tension straps 77 are fixed to the housing 56 and carry a horizontal bar 78 extending therebetween above the upper spring retainer 75. Bar 78 carries a stud 79 threadedly engaged therewith and held in position with a lock nut 80. The lower end of the stud bears against the upper spring retainer 75. As in the embodiment already described, the stud is a load cell and contains a strain gauge 81, but similar equivalents are possible. Preferably the upper spring retainer also carries a pair of lifting eyes 82 to facilitate lifting the chocks and rolls from the housing.

When a casting 18 is between the rolls 61 and 62, it exerts a downward force on the lower roll 61 and an upward force on the upper roll 62. The force on the upper roll is transmitted through the upper spacer bar 75, overload spring 74 and upper spring retainer 75 to the stud 79. The overload spring act as a rigid body during normal operation, but can yield to allow overloads to pass, as in the embodiment already described. The stud 79 is in compression, and a read out device connected to the strain gauge 81 indicates the compressive force on the stud or the force exerted between the casting and the rolls. If this force deviates from the norm, we need only turn the stud 79 to correct the gap between the rolls 61 and 62.

From the foregoing description, it is seen that our invention affords a simple effective method and mechanism for controlling forces exerted between opposed roll-pairs of a continuous-casting machine and a casting traveling therebetween. The invention measures the force and enables in the dimension of the gaps between rolls of each pair to be corrected simply by turning a nut or stud. Such corrections can be made expeditiously between casts and there is no need to dismantle the machine partially as needed to insert or remove shims. The invention also affords overload protection to the rolls and chocks without necessity of damaging any part of the machine.

We claim:

1. In a continuous-casting operation in which a partially solidified casting having a liquid core travels between a series of opposed roll-pairs which guide the casting and confine it against bulging, the rolls of each pair being journaled for rotation on relatively fixed but adjustable axes and having a gap of predetermined dimension therebetween and in which the force exerted between the roll-pairs and casting is measured at each roll-pair, an improved method of controlling forces exerted between the rolls and casting to prevent the casting from bulging if the gap is too large and to prevent improper stresses in the casting and rolls or the gap is too small, said method comprising utilizing deviations in the force measurement from the norm to locate improperly gapped roll-pairs and correcting the dimension of the gap with adjustment means operatively connected to each roll pair.

2. A method as defined in claim 1 in which correction of the gap dimension is effected by turning a screw-threaded adjustment means.

3. A method as defined in claim 2 in which the measurement of the force at each roll-pair is obtained in a respective load cell, said method comprising a further step of transmitting force to said load cell through an overload spring which acts as a solid body during normal operation of the roll-pair, but permits the rolls to yield to pass overloads.

4. A method as defined in claim 3 in which the force on said load cell is a tensile force.

5. A method as defined in claim 3 in which the force on said load cell is a compressive force.

6. In a continuous-casting machine which includes a plurality of opposed roll-pairs for guiding and confining a partially solidified casting having a liquid core while it travels therebetween, means journaling said roll-pairs for rotation on normally fixed but adjustable axes, the rolls of each pair having a gap of predetermined dimension therebetween, and respective force-measuring means operatively connected with each of said roll-pairs, the combination therewith of an improved mechanism for controlling forces exerted between the roll-pairs and a casting to prevent the casting from bulging if the gap is too large and to prevent improper stresses in the casting and rolls if the gap is too small, said mechanism comprising respective adjusting means operatively connected with each roll-pair for correcting the dimension of the gap in any roll pair in which the measured force deviates from the norm.

7. A combination as defined in claim 6 in which said adjusting means is screw threaded.

8. A combination as defined in claim 7 in which said adjusting means comprises respective force-measuring studs, and means engaging said studs at spaced apart locations for transmitting to said studs the force on each roll of the pair and thereby applying to the studs forces representing the forces exerted between the rolls and casting, said studs having threaded engagement for effecting adjustments in the dimension of the gaps.

9. A combination as defined in claim 8 in which said means for transmitting force to said studs includes respective overload springs which act as rigid bodies during normal operation of the roll-pairs, but which permit the roll pairs to yield to pass overloads.

10. A combination as defined in claim 9 in which the force on said studs is a tensile force.

11. A combination as defined in claim 9 in which the force on said studs is a compressive force.

12. In a continuous-casting machine includes a roll-rack for guiding and confining a casting before the casting becomes self-sustaining, said roll-rack comprising:

a plurality of opposed roll-pairs each having a lower roll and an upper roll;

lower and upper chocks in which the respective rolls of each pair are journaled for rotation on normally fixed axis;

lower spacer bars connecting the respective lower chocks at opposite sides of the rack and upper spacer bars connecting the respective upper chocks at opposite sides of the rack;

means supporting said chocks and urging them apart to provide gap of predetermined dimension between the rolls of each pair; and force-measuring means operatively connected with the rolls of each pair for measuring the force exerted between the rolls and casting;

the combination therwith of an improved mechanism for controlling the force, said mechanism comprising:

respective adjustable screw-threaded force-measuring studs; and a member in compression and a member in tension engaging the respective studs at spaced apart locations on the stud for transmitting to the studs forces representing the forces exerted between the rolls and casting;

adjustment of said studs effecting corrections in the dimension of the gap of any roll-pair in which the force measurement deviates from the norm.

13. A combination as defined in claim 12 in which the member in compression includes an overload spring which acts as a rigid body in normal operation of the roll-rack but which permits said rolls to yield to pass overloads.

14. A combination as defined in claim 12 in which the member in tension includes tension straps.

15. An improved roll-rack for guiding and confining a casting before the casting becomes self-sustaining, said roll-rack comprising:

at least one opposed roll-pair;

chocks in which the respective rolls are journaled for rotation on normally fixed axis;

spacer bars connecting the respective chocks at opposite sides of the rack for each roll;

means supporting said chocks and urging them apart to provide a gap of predetermined dimension between the rolls; and force-measuring means operatively connected with the rolls for measuring the force exerted between the rolls and casting;

the combination therewith of an improved mechanism for controlling the force, said mechanism comprising:

respective adjustable screw-threaded studs which effect corrections in the dimension of the gap of said roll-pair in which the force measurement indicates a needed correction; and a member in compression and a member in tension engaging the force measuring means at spaced apart locations on the force measuring means for transmitting to the force measuring means forces representing the forces exerted between the rolls and casting.

16. A roll-rack as defined in claim 15 in which one of the members for transmitting forces to the force-measuring means includes an overload spring which acts as a rigid body during normal operation of the roll-pair, but which permits the roll-pair to yield to pass overloads.

* * * * *

UNITED STATES PATENT OFFICE

CERTIFICATE OF CORRECTION

Patent No. 4,056,140 Dated November 1, 1977

Inventor(s) Kenneth D. Ives, Ronald S. Vranka and George J. Wagner, Jr.

It is certified that error appears in the above-identified patent and that said Letters Patent are hereby corrected as shown below:

Column 5, claim 1, line 3, change "or" to --if--.

Signed and Sealed this

Fourteenth Day of March 1978

[SEAL]

Attest:

RUTH C. MASON
Attesting Officer

LUTRELLE F. PARKER
Acting Commissioner of Patents and Trademarks